US005927387A

United States Patent [19]

Nyström

[11] Patent Number: 5,927,387

[45] Date of Patent: Jul. 27, 1999

[54] HEAT EXCHANGER

[75] Inventor: Bernt Nyström, Huddinge, Sweden

[73] Assignee: Air Innovation Sweden AB, Sweden

[21] Appl. No.: 09/068,811

[22] PCT Filed: Nov. 18, 1996

[86] PCT No.: PCT/SE96/01489

§ 371 Date: Sep. 8, 1998

§ 102(e) Date: Sep. 8, 1998

[87] PCT Pub. No.: WO97/19310

PCT Pub. Date: May 29, 1997

[30] Foreign Application Priority Data

Nov. 17, 1995 [SE] Sweden ..... 9504107

[51] Int. Cl.[6] ..... F28D 9/00; F28F 21/06

[52] U.S. Cl. ..... 165/103; 165/54; 165/166; 165/905; 165/145

[58] Field of Search ..... 165/54, 166, 905, 165/145, 103

[56] References Cited

U.S. PATENT DOCUMENTS

| | | | |
|---|---|---|---|
| 2,828,947 | 4/1958 | Hedbom . | |
| 4,377,201 | 3/1983 | Kruse et al. | 165/166 |
| 4,579,163 | 4/1986 | Maendel | 165/54 |
| 5,181,562 | 1/1993 | Kuriki | 165/166 |

FOREIGN PATENT DOCUMENTS

| | | | |
|---|---|---|---|
| 0086175 | 6/1983 | European Pat. Off. . | |
| 0462199 | 7/1995 | European Pat. Off. . | |
| 1371493 | 7/1964 | France . | |
| 3137296 | 4/1983 | Germany . | |
| 19519511 | 12/1995 | Germany . | |
| 238587 | 8/1926 | United Kingdom | 165/103 |
| 343600 | 2/1931 | United Kingdom | 165/103 |
| 8103064 | 10/1981 | WIPO . | |

*Primary Examiner*—John K. Ford
*Attorney, Agent, or Firm*—Ostrolenk, Faber, Gerb & Soffen, LLP

[57] ABSTRACT

A heat exchanger, preferably intended for air conditioning in a fan installation, comprises a corrugated plastic element built up of heat exchanger packs. One of the air flows passes laminarly and unbroken in vertical flow paths formed between strips that hold the individual elements apart from each other. The other air flow passes through channels formed in each element. The walls of the element are thin and the thinner the wall thickness the better the efficiency obtained.

10 Claims, 3 Drawing Sheets

HEAT EXCHANGER

TECHNICAL FIELD

The present invention relates to a heat exchanger, preferably used for air conditioning in a fan installation where the heat exchange takes place between extract air and input air.

BACKGROUND ART

In heat exchangers of the above-mentioned type the input and extract air usually pass in opposite directions on each side of heat-exchanger sections shaped with rhomboid cross section in a drum, as described in U.S. Pat. No. 4,377,201, for instance. The oppositely-directed air flows are thus forced to run in meandering flow, thereby entailing relatively high power consumption.

To reduce the power consumption a heat exchanger is known through EP-A-0 462 199 in which the heat-exchanger sections are arranged with spaces aligned with each other so that one of the air flows (normally the input air) has a linear direction of flow. However, the linear flow is disturbed by the formation of eddy currents each time it enters or leaves the heat-exchanger sections. These eddy currents thus still cause increased power consumption, i.e. poorer efficiency.

In known heat exchangers of the above-mentioned types, each heat-exchanger section is surrounded by a frame. This means that the degree of heat recovery is deteriorated since a considerable part of the available heat-exchanger surface is taken up by the frame.

The principle on which the present invention is based is shown in DE,A1,3137296. However, this publication does not show the specific features of the present invention which give the heat exchanger according to the invention properties not previously achieved.

DESCRIPTION OF THE INVENTION

A primary object of the invention is to provide a heat exchanger in which the power consumption is minimal and which thus has a high degree of efficiency, as well as being easy to inspect and clean.

This is achieved in that, according to the invention, the extract or input air has an unbroken flow through the heat exchanger while the other air flow has a transverse flow direction that passes the exchanger at least twice.

An advantageous embodiment of the heat exchanger according to the invention comprises heat-exchanger elements in which one air flow (e.g. the extract air) passes between adjacent elements whereas the other air flow (e.g. the input air) passes in channels arranged inside each element.

Further developments of the heat exchanger according to the invention are revealed in the independent claims.

Known heat exchangers are usually manufactured of material with good thermal conductivity, see the publications mentioned above for instance. Besides entailing high material and manufacturing costs, such heat exchangers are extremely heavy. A heat exchanger according to the present invention also eliminates these drawbacks since a highly efficient heat exchanger can be made from recoverable plastic material that requires little energy for manufacture or re-use.

An extremely high degree of recovery is achieved with the heat exchanger according to the invention since no frame is used.

Another advantage of the heat exchanger according to the invention is that the exchanger can easily be adapted to requirements of double, triple or quadruple transverse-flow exchangers. The use of three and four steps is in order to obtain higher efficiency and to be able to fit the connections of the exchanger to existing ventilation connections when carrying out conversions. The exchanger sections may be varied and not all the steps need be the same size. The exchanger also has completely flat surfaces.

BRIEF DESCRIPTION OF THE DRAWINGS

The heat exchanger according to the invention will be described in more detail with reference to the accompanying drawings illustrating a preferred embodiment, in which.

Figure 1:
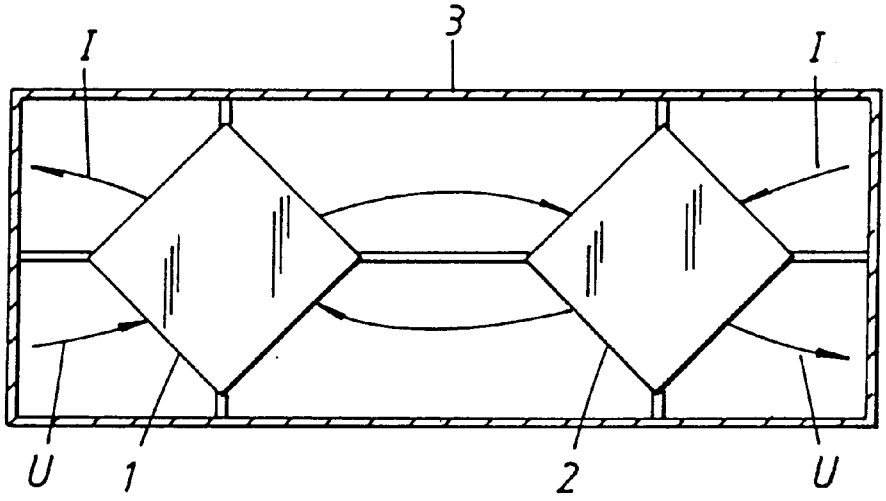
FIGS. 1 and 2 show the principle for two known heat exchangers.

As can be seen in FIG. 1 illustrating a commercially available heat exchanger, both the input and the extract air, I and U respectively, are forced to pass on each side of the heat-exchanger sections 1, 2 in meandering flows. As stated above, this gives rise to power losses.

Figure 2:
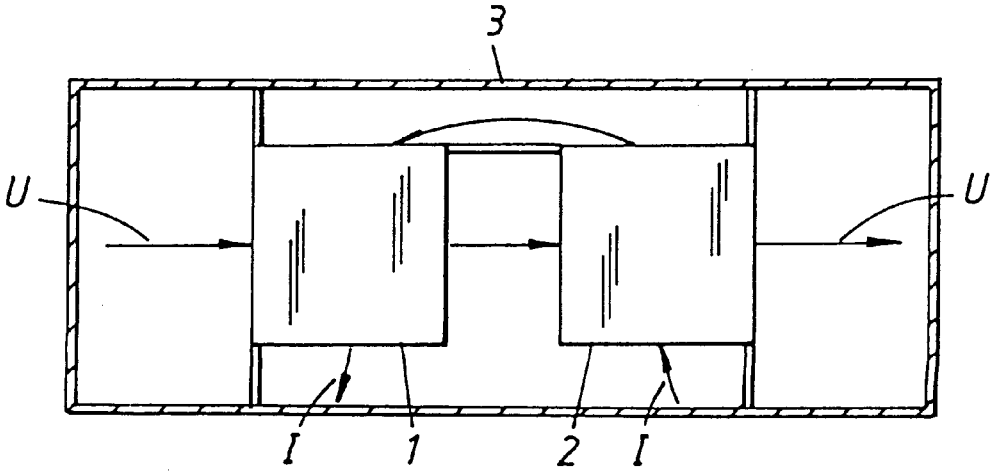

Another known embodiment of heat exchanger is illustrated in FIG. 2, also comprising two heat-exchanger sections 1, 2 in a heat-exchanger drum 3. Although in this case one of the air flows U passes straight through the heat-exchanger sections 1, 2, aligned with each other, eddy currents will be formed when the air flow enters and leaves each heat-exchanger section 1, 2, thus increasing the energy consumption.

Figure 3:
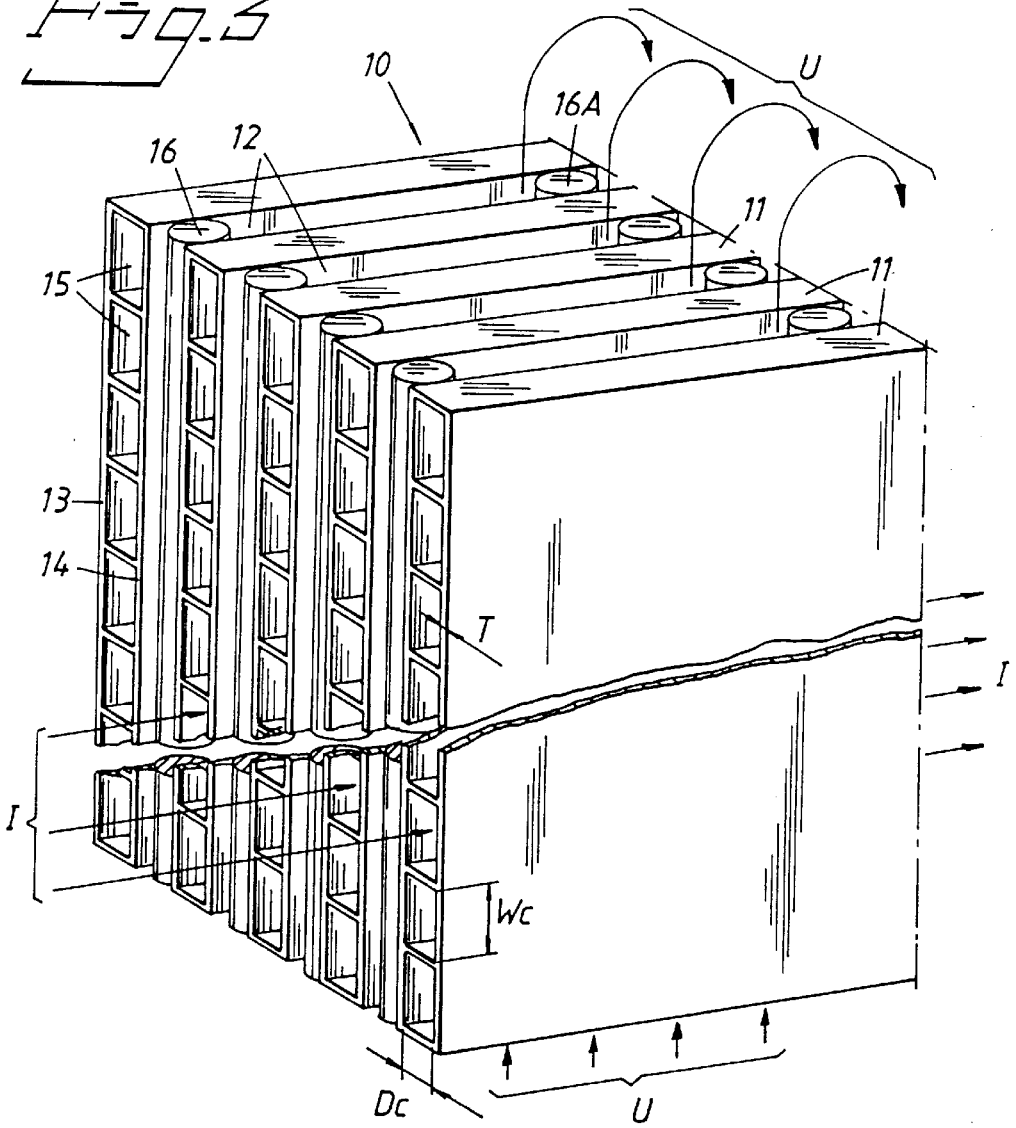
FIG. 3 shows the principle in a part of a heat-exchanger pack for a heat exchanger according to the invention.

These problems are eliminated with the heat exchanger according to the invention in which the principle is that one air flow U has an unbroken flow through the heat exchanger 10 as shown in FIG. 3. This figure shows a part of a heat-exchanger pack intended to fit into a heat-exchanger drum, described in more detail below, and is formed of a large number of heat-exchanger elements 11 which are stacked or packed to form a heat-exchanger section. This section has no frame and can in turn be divided for repeated passage of transverse flows. There is thus no gap of the type existing between the heat-exchanger sections in previously known heat exchangers. Flow paths 12 are formed between pairs of elements 11, through which extract air U flows in the example shown. The heat-exchanger elements 11 are each formed by thin-walled plates 13, 14, which form channels 15 between them for the other air flow, in the example shown the input air I.

The heat-exchanger elements 11 are preferably made of plates of corrugated plastic type, the walls 13, 14 of which have a thickness T of 0.05–0.80 mm. The thinner the plastic material, the better the heat transfer obtained. The channels 15 in the corrugated plastic have a depth Dc of approximately 2.0–6.0 mm and a width Wc of approximately 3–25 mm, preferably 6 mm.

The plastic material used is preferably a polypropylene or polycarbonate plastic, the latter type being particularly advantageous since it has high fire class (B1 according to Swedish standards). A plastic heat exchanger permits almost any imaginable air quality for heat recovery, e.g. both kitchen and industrial extract air. The plastic is mechanically stable and therefore suitable for cleaning with blast air or high-pressure jet cleaning.

The corrugated plastic plates or elements 11 are joined together with the aid of durable packing strips 16, the cross section of which may be rectangular but is preferably circular. The strips 16 define the depth Dp and width Wp of the narrow but unbroken, straight flow paths 12. The depth Dp is thus approximately 2.0–6.0 mm, preferably 2.3–2.5 mm. With a distance between strips of approximately 15 cm, a corresponding width Wp of approximately 15 cm is obtained for the flow paths 12.

Figure 4:
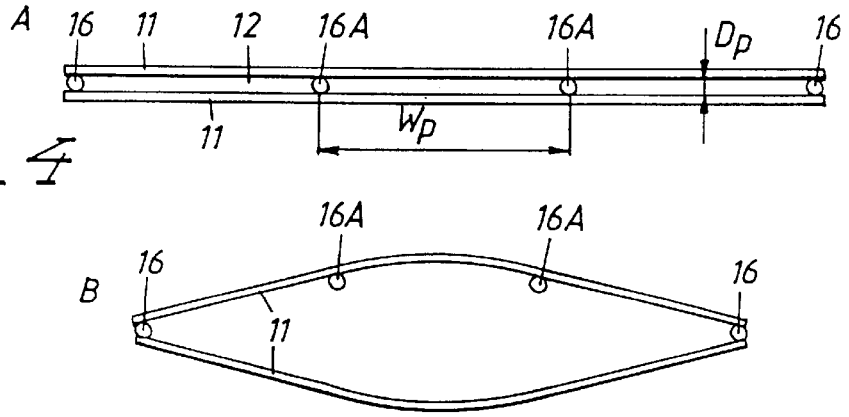
FIG. 4 shows a further development of a pair of elements for the heat exchanger according to FIG. 3.

The strips are fixed at at least one flat surface of the pairs of facing elements 11. Preferably every fourth to every eighth strip 16 is fixed to both opposing surfaces of the elements 11, while intermediate strips 16A are only, fixed to one of the elements 11 as shown in FIG. 4. This enables efficient cleaning of the heat-exchanger elements 11 since, without dismantling the heat exchanger, they can be enlarged as shown in FIG. 4B.

The strips 16, 16A can be fixed by gluing, welding or in some other suitable manner.

During operation, unfiltered extract air U flows along the outer side of the corrugated plastic plates or elements 11 in the paths 12 formed by the strips 16, 16A. Since the flow direction is vertical and the air unfiltered, there is no risk of freezing however cold the extract air U becomes after the heat exchanger.

Using long, thin plastic elements 11 in large heat exchangers a temperature efficiency degree of more than 90% can be obtained. The longer the operating time the higher the total efficiency since no defrosting is required.

Thus, using the heat-exchanger element 11 according to the present invention, one or more heat-exchanger sections can be built up to produce a heat exchanger 10. Contrary to known technology, when several of these heat-exchanger sections are used, according to the invention they are joined together with no space between them. In previously known heat exchangers the exchange has occurred twice at most, see FIGS. 1 and 2, but the heat exchanger 10 according to the invention allows up to four exchanges.

Figure 5:
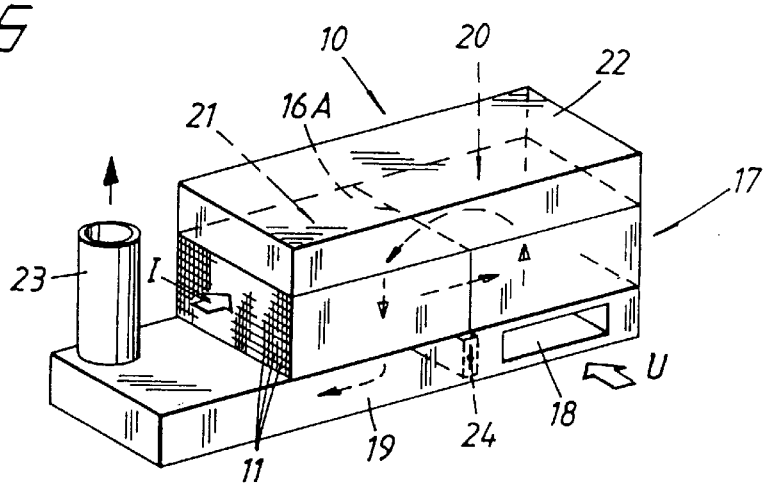
FIG. 5 shows a double transverse-flow exchanger according to the invention.

A first complete embodiment of the invention is shown in FIG. 5 as a double transverse-flow exchanger of the counter-flow type. Input air I flows continuously through a heat-exchanger section 17 built up of a number (approximately 100) of heat-exchanger elements 11. Extract air U is conducted into the heat-exchanger section 17 through an inlet 18 located in an inlet part in a first adjoining chamber 19 situated along the entire transverse side of the heat-exchanger section 17. Thereafter the extract air U crosses a first step 20 of the heat-exchanger section 17 which is divided for the extract air U in said first step 20 and a second step 21. A second adjoining chamber 22 is arranged along the other transverse side of the heat-exchanger section 17, in which the extract air U is deflected in order to pass the heat-exchanger section 17 again through its second step 21 and through an outlet part in the first adjoining chamber 19, then continuing out through the exchanger 10 via an outlet 23 fitted in the first adjoining chamber 19.

Division of the heat-exchanger section 17 into two steps is achieved by the strips 16A being sealingly inserted between the heat-exchanger elements 11 as an extract-air barrier. A damper 24 is arranged connected to the strips 16A towards the ends facing the first adjoining chamber 19, sealing against the side of the heat-exchanger element 11 facing the first adjoining chamber 19, said damper dividing the adjoining chamber 19 into said inlet and outlet parts. The damper 24 is arranged in closed position (shown in FIG. 5) to force the extract air U through the heat-exchanger section 17 twice, and in open position to allow the extract air U to pass through the entire heat-exchanger section 17. The extract-air barrier and the damper 24 are formed as a unit which is fitted from the "damper side" of the heat exchanger.

Figure 6:
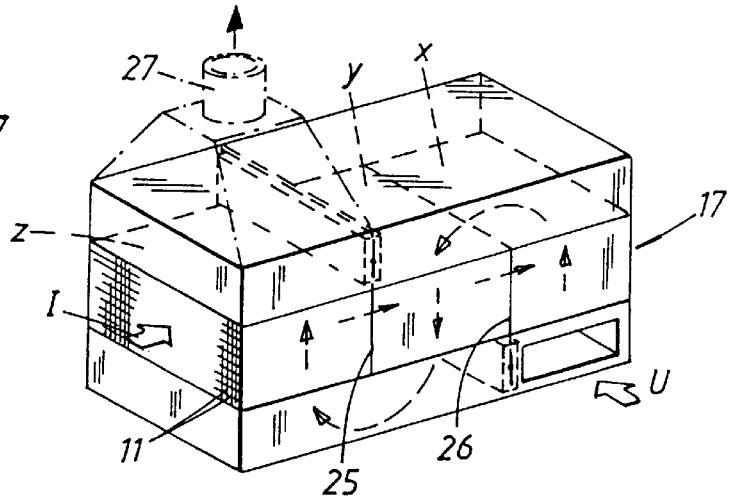
FIG. 6 shows a triple transverse-flow exchanger according to the invention.

A second complete embodiment of the invention is shown in FIG. 6 as a triple transverse exchanger of counter-flow type. In this embodiment the heat-exchanger section 17 is divided into three steps, step x, step y and step z. The three steps of the exchanger section 17 according to this embodiment are defined by a first extract-air barrier 25 and a second extract-air barrier 26, both built up of strips 16A and damper 24 as described above. This embodiment is also provided with a collection channel 27 at the outlet for the extract air. The exchanger has three exchanging facilities:

1) full exchange through all exchange steps x, y, z when both dampers are closed;
2) exchange through step x when only the damper in the first extract-air barrier 25 is open;
3) exchange through step z when only the damper in the second extract-air barrier 26 is open.

A three-step exchanger according to the embodiment in FIG. 6 is thus achieved by merely adding an additional extract-air barrier and a modified outlet to the two-step heat exchanger according to FIG. 5.

Figure 7:
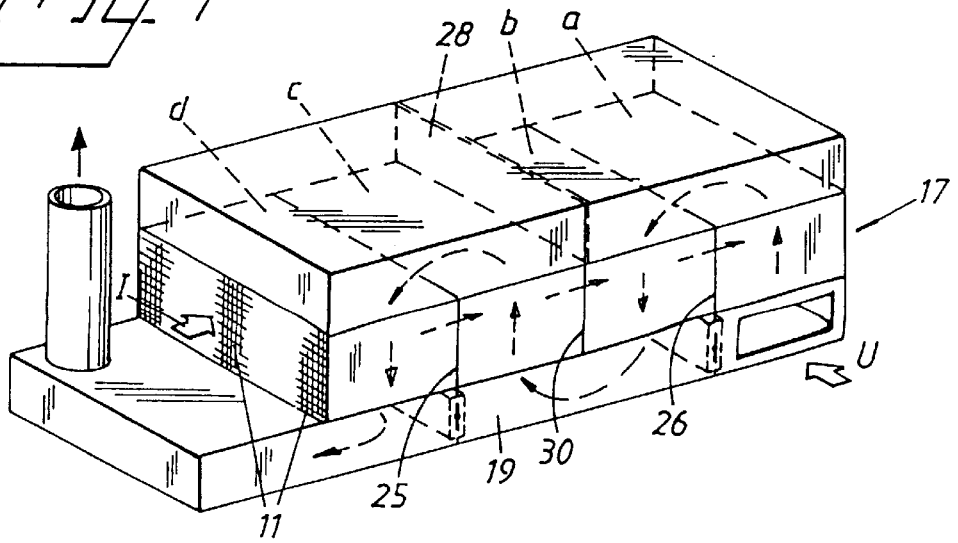
FIG. 7 shows a quadruple transverse-flow exchanger according to the invention.

A third complete embodiment of the invention is shown in FIG. 7 as a quadruple transverse-flow exchanger of counter-flow type. The heat-exchanger section 17 in this embodiment is divided into four steps: step a, step b, step c and step d. Steps a and b and steps c and d, respectively are divided by an extract-air barrier 26, 25 of the type described above, whereas steps b and c are divided from each other by an extract-air barrier 30 provided with an air wall 28 which sealingly separates an adjoining chamber instead of a damper as before. This extract-air barrier 30 provided with an air wall is arranged so that the air wall 28 faces the opposite side from the damper. This exchanger can be seen as a double two-step exchanger. A two-step exchanger according to FIG. 5 can thus be made into a four-step exchanger according to FIG. 7 by adding an additional extract-air barrier provided with a damper and an extract-air barrier provided with an air wall. Here too, the four-step exchanger can be run as a two-step exchanger if one damper is open and one is closed. With both dampers open, no exchange is obtained at all.

Although the heat exchanger according to the invention has been described in conjunction with a number of preferred embodiments, it should be obvious to one skilled in the art that other variations and modifications are possible without departing from the concept of the invention as defined in the appended claims.

I claim:

1. A heat exchanger comprising a heat-exchanger section with a pack of heat-exchanger elements where the heat exchange is arranged to take place between extract air and input air, either the extract or the input air being arranged to have an unbroken, laminar flow through the heat exchanger, while the other air flow is arranged to pass at least twice through the heat-exchanger section and one air flow being arranged to pass between each adjacent element, said elements comprising two thin-walled plates with surfaces facing away from each other, wherein the inner surfaces of the elements face each other through sectioning form channels and wherein the elements form gap-like flow paths for one of the air flows by means of strips arranged between the facing smooth outer surfaces of two adjacent elements, whereas the other air flow is arranged to be conducted in said channels inside each element, wherein at least one of the strips is fixed at at least one of the facing outer surfaces of the elements, and every fourth to every eighth strip (16) of the strips are secured to both the facing outer sides of the elements, whereas the intermediate strips are only secured to the outer surface of one element.

2. A heat exchanger as claimed in claim 1, wherein the ends of the strips at one side of the heat-exchanger section are connected to a blocking means situated in one of two adjoining chambers adjacent the heat-exchanger section, forming a barrier for extract air, for the air flow, in order to divide the heat-exchanger section into at least two steps.

3. A heat exchanger as claimed in claim 2, wherein the heat-exchanger section is divided by means of an extract-air barrier in a first step and a second step so that the blocking member in the form of a damper is situated in the first adjoining chamber.

4. A heat exchanger as claimed in claim 2, wherein the heat-exchanger section is divided by two extract-air barriers into three steps so that the blocking member in the form of a damper in the first extract-air barrier is situated in the second adjoining chamber and that the blocking member in the form of a damper in the second extract-air barrier is situated in the first adjoining chamber.

5. A heat exchanger as claimed in claim 2, wherein the heat-exchanger section is divided by means of three extract-air barriers into four steps so that the blocking member in the form of a damper in the first extract-air barrier is situated in the first adjoining chamber and that the blocking member in the form of a damper in the second extract-air barrier is situated in the first adjoining chamber and that the blocking member in the form of an air wall in the third extract-air barrier is situated in the second adjoining chamber, the third extract-air barrier being situated between the first extract-air barrier and the second extract-air barrier.

6. A heat exchanger as claimed in claim 1, wherein the wall thickness of the plates is approximately 0.05–0.80 mm.

7. A heat exchanger as claimed in claim 1 wherein the channels have a depth of approximately 2.0–6.0 mm and a width of approximately 3–25 mm.

8. A heat exchanger as claimed in claim 1, wherein the gap-like flow paths have a depth of approximately 2.0–6.0 mm which depth is defined by the strips the cross section of which is preferably circular, and by the force with which the heat-exchanger pack is joined together.

9. A heat exchanger as claimed in claim 1, wherein the heat-exchanger section is arranged to be divided into an optional number of steps with extract-air barriers insertable into the section and sealing between the heat-exchanger elements.

10. A heat exchanger as claimed in claim 1 intended for air conditioning in a fan installation.

* * * * *